United States Patent [19]

Goldberg

[11] Patent Number: 4,813,543

[45] Date of Patent: Mar. 21, 1989

[54] STACKABLE AND NESTABLE CONTAINER FOR FOODSTUFFS

[76] Inventor: Leslie H. Goldberg, 11 Foursome Cr., Willowdale, Ontario, M2P 1W1, Canada

[21] Appl. No.: 930,111

[22] Filed: Nov. 13, 1986

[51] Int. Cl.[4] ..... B65D 21/04

[52] U.S. Cl. ..... 206/507

[58] Field of Search ..... 206/507; 220/359, 366

[56] References Cited

U.S. PATENT DOCUMENTS

| | | | |
|---|---|---|---|
| 1,689,641 | 10/1928 | Pickles | 220/366 |
| 2,852,157 | 9/1958 | Frater | 206/507 |
| 3,197,058 | 7/1965 | Hale | 206/507 |
| 3,203,576 | 8/1965 | Rowe | 206/507 |
| 3,794,090 | 2/1974 | Commisso | 220/366 |
| 4,201,301 | 5/1980 | Aggio | 206/507 |
| 4,355,755 | 10/1982 | Faller | 220/366 |
| 4,373,636 | 2/1983 | Hoffman | 220/366 |
| 4,399,159 | 8/1983 | Guibert | 220/366 |
| 4,426,401 | 1/1984 | Oftow | 220/366 |

FOREIGN PATENT DOCUMENTS

| | | | |
|---|---|---|---|
| 2533631 | 2/1977 | Fed. Rep. of Germany | 270/359 |
| 1363346 | 5/1964 | France | 206/507 |
| 2547561 | 12/1984 | France | 206/507 |

*Primary Examiner*—George E. Lowrance

*Attorney, Agent, or Firm*—Sim & McBurney

[57] ABSTRACT

A stackable and nestable container for foodstuffs, includes a body formed as an integral unit defining an upwardly open recess, the recess having a bottom wall and a downwardly convergent side wall. The side wall has step portions at intervals around it, and non-step portions spaced from the step portions so that when two such containers are rotationally oriented in a first position with respect to each other, the step portions of the containers coincide to allow close nesting. Conversely, when the containers are rotationally oriented in a second position, the step portions of one container coincide with the non-step portions of the other to allow spaced stacking of the containers.

12 Claims, 1 Drawing Sheet

STACKABLE AND NESTABLE CONTAINER FOR FOODSTUFFS

This invention relates generally to containers especially suited for protecting and maintaining the temperature of foodstuffs, but not necessarily restricted thereto. More particularly, this invention provides a novel construction for a stackable and nestable container.

BACKGROUND OF THIS INVENTION

Many container designs have been developed for protecting foodstuffs such as cakes, pizzas and the like, some of which also have the capability of minimizing heat exchange with the ambience. However, most fast-delivery pizza houses still utilize thin cardboard boxes of conventional construction. A disadvantage of such boxes is that some of the substances used in the manufacture of the box can leave a characteristic undesirable smell on the food product. Another disadvantage is the fact that the food product cannot be seen without opening the box, thus making it difficult for the customer to verify the order at the time of delivery. Yet another disadvantage of cardboard boxes is their relative bulk, requiring a substantial amount of storage space to store an adequate number for a typical delivery food service. Still another disadvantage is the fact that the cardboard box, with the pizza or other food product inside, cannot or should not be placed in an oven to re-heat the food product, due to the danger of burning the box.

Several alternative container constructions have been developed in the prior art, but these are generally expensive and complex, thus discouraging their use.

Exemplary of this prior art are the following patents:

U.S. Pat. No. 3,130,288, issued Apr. 21, 1964 to Monaco et al;

U.S. Pat. No. 3,428,103, issued Feb. 18, 1969 to Walsh;

U.S. Pat. No. 4,344,543, issued Aug. 17, 1982 to Sutton;

U.S. Pat. No. 3,353,886, issued Nov. 21, 1967 to Tompkins;

U.S. Pat. No. 4,373,636, issued Feb. 15, 1983 to Hoffman;

U.S. Pat. No. 4,058,214, issued Nov. 15, 1977 to Mancuso;

U.S. Pat. No. 3,016,129, issued Jan. 9, 1962 to King.

GENERAL DESCRIPTION OF THIS INVENTION

In view of the foregoing disadvantages of the prior art, it is an object of an aspect of this invention to provide a container for foodstuffs and the like which is inexpensive and simple to manufacture, which provides good thermal protection for the contents, and which is capable of three different modes of vertical stacking. A first mode may be termed "nesting", in which a plurality of the items are nested together for storage purposes. A second mode may be termed full-height stacking, in which a plurality of containers, each with a lid in place, are stacked one on top of the other. The third mode may be termed "partial-height stacking", in which only the top container of the stack has a lid, and the containers below the top container are interfitted in such a way that each container provides a lid function for the container underneath it.

More particularly, this invention provides a stackable and nestable container for foodstuffs, the container including a body formed as an integral unit defining an upwardly open recess. The recess has a bottom wall and a downwardly convergent side wall. The side wall defines step portions at intervals around the side wall and non-step portions spaced from the step portions in such a way that, when two such containers are rotationally oriented in a first position with respect to each other, the step portions of the containers coincide to allow close nesting of the containers, and when the containers are rotationally oriented in a second position with respect to each other, the step portions of one container coincide with the non-step portions of the other container to allow spaced stacking of the containers wherein the step portions of the lower container support substantially all of the weight of the higher container with the bottom wall of the higher container spaced upwardly away from the bottom wall of the lower container.

GENERAL DESCRIPTION OF THE DRAWINGS

One embodiment of this invention is illustrated in the accompanying drawings, in which like numerals denote like parts throughout several views, and in which.

DETAILED DESCRIPTION OF THE DRAWINGS

Figure 1:
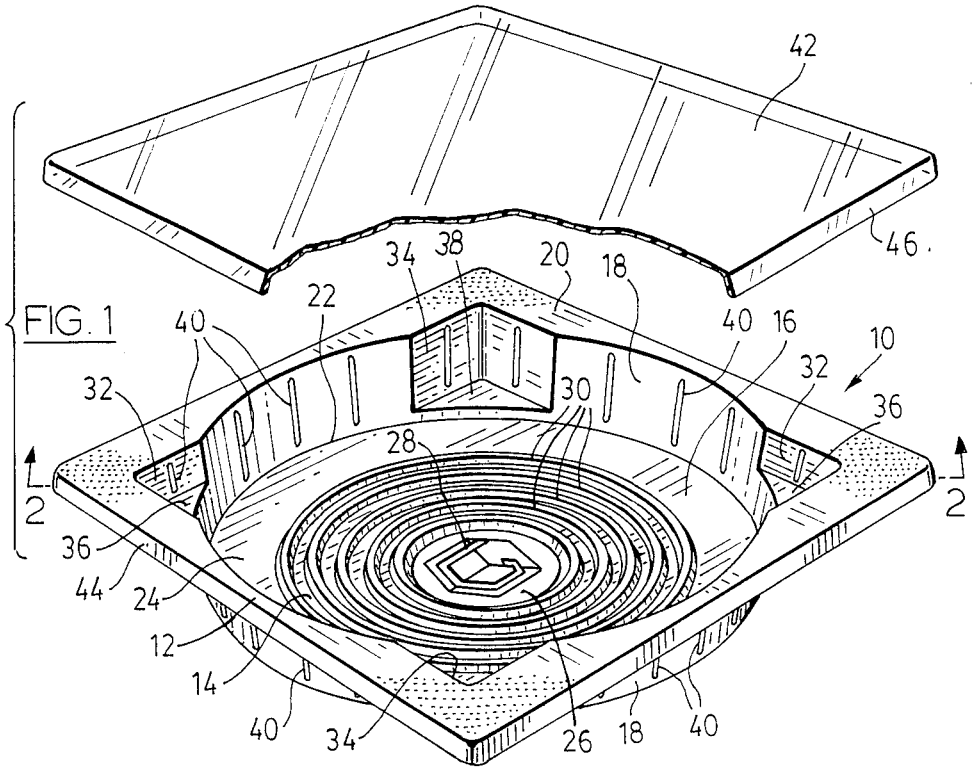
FIG. 1 is a partly broken-away perspective view of a container constructed in accordance with this invention, including a lid.

Attention is first directed to FIG. 1, which shows a stackable and nestable container generally at 10, the container 10 being in the form of a body 12 formed as an integral unit defining an upwardly open recess 14. More specifically, the recess 14 is defined by a bottom wall 16, and downwardly convergent side walls 18.

As can be seen, the recess 14 is substantially circular in plan outline, and converges downwardly from an upper flange portion 20 to the bottom wall 16, which has a circular periphery 22. The upper flange portion 20 projects outwardly from the top of the recess 14 in a plane parallel to the plane of the bottom wall 16. In actual fact, the bottom wall 16 of the embodiment illustrated is only approximately in a plane. As can be seen by comparing FIGS. 1 and 2, the bottom wall 16 includes an outer peripheral trough 24 running concentrically around the bottom wall 16, a central depression 26 which may contain a logo such as that shown at 28 in FIG. 1, and a plurality of concentric ribs 30.

As is well illustrated in the figures, the side wall 18 is broken at diametrally opposed locations by two step portions 32. Further, the side wall 18 is broken at two additional diametrally opposed locations by two non-step portions 34. Specifically, the step portions 32 and the non-step portions 34 project outwardly beyond the circular outline of the recess 14 in such a way that the non-step portions 34 are 90° rotated with respect to the step portions 32. Looking at FIGS. 1 and 2, each step portion 32 includes a substantially flat contact wall 36 at a location approximately halfway between the bottom wall 16 and the flange portion 20. By contrast, the non-step portions 34 each have a lower wall 38 which is only marginally raised above the outer peripheral trough 24.

The side wall 18 has a plurality of vertical stiffening ribs 40, some of which are located within the step portions 32 and the non-step portions 34.

The container 10 may be used in conjunction with a lid 42. In the embodiment illustrated, the lid 42 is made of transparent material, so that the contents of the container 10 can be viewed from the outside. In the construction illustrated, the flange portion 20 is of square outline with a downwardly projecting flange 44 around its periphery. In like manner, the lid 42 is square in outline, and also has a downwardly projecting flange 46 adapted to enclose the flange 44.

Figure 2:
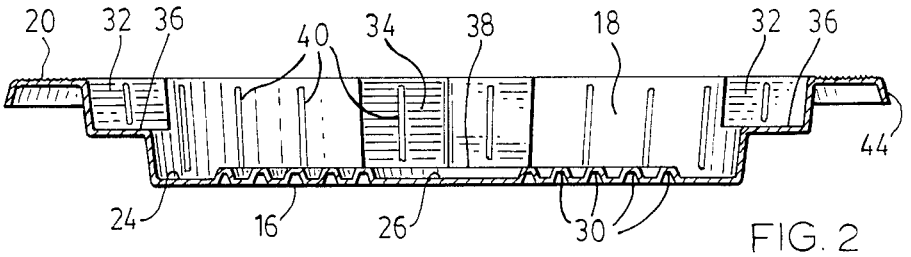
FIG. 2 is a diagonal sectional view taken at the line 2—2 in FIG. 1.

As can be seen at the right in FIG. 2, flange portion 20 may be provided with regular indentations to cause the surface to be rough in order that, when the lid 42 is in place, air may still enter or leave the recess 14 in order to equalize the pressure within the recess during freezing or heating. For other uses, however, it may be preferred that the flange 20 be flat so as to mate in surface contact with the lid 42 to permit the two to be heat-sealed together. At the left in FIG. 2, the flange portion 20 is seen to be flat. FIG. 2 thus shows two variants with regard to the structure of the flange portion 20. It is to be understood, however, that in any given embodiment, the surface of the flange portion 20 would be consistent throughout.

Figure 3:
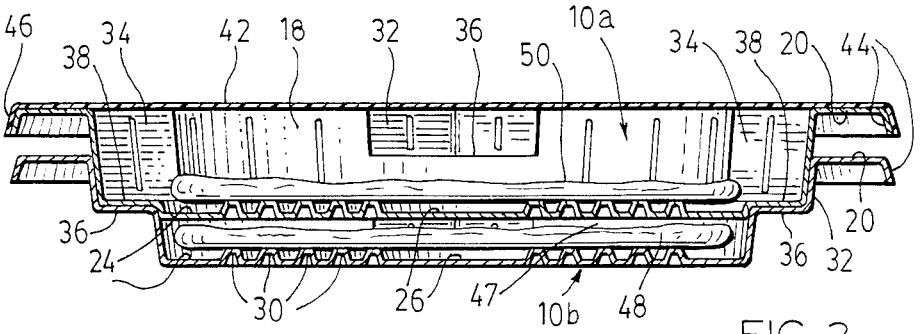
FIG. 3 is a diagonal sectional view taken through two identical containers, with the one being rotated through 90° with respect to the other to show the spaced stacking.

Attention is now directed to FIG. 2, which shows what has been described at the beginning of this disclosure as the third mode of stacking for the container shown in FIG. 1. In FIG. 3, two identical containers **10*a* and 10*b* are stacked together, with the container 10*a* rotated through 90° with respect to the container 10*b*, so that the step portions 32 of container 10*b* coincide with the non-step portions 34 of container 10*a*. The section of FIG. 3 is taken through these portions. It will be seen that, in effect, the flat contact walls 36 of the step portions of the lower container 10*b* are taking the full weight of the upper container 10*a*, and that the bottom walls 38 of the non-step portions of the upper container 10*a* are resting against the contact walls 36 of the lower container 10b. This provides a space shown at 47 in FIG. 3, between the bottom walls of the two containers 10*a* and 10*b*. Within this space 47 is provided a first pizza 48, while the upper container 10*a* contains a second pizza 50. It will be appreciated from the illustration of FIG. 3 that additional stacked containers could be provided below the two illustrated, in such a way that additional half-height spaces would be defined between each adjacent pair of containers, these spaces all being similar to the space 47 shown in FIG. 3. The upper container 10*a* is provided with a lid 42, which closes the recess 14 within the container 10*a*. It can be seen that, in effect, with the exception of the upper container 10*a***, each lower container would have its recess closed and reduced about 50% in height by the container next above it.

It will be appreciated that the design of container shown in the figures is ideal for stacking as shown in FIG. 3 for the purpose of transporting a plurality of pizzas, due to the fact that pizzas do not require the full height of the recess 14 illustrated in FIG. 1. However, the container 10 shown in FIG. 1 could also be utilized for food items with greater height, such as cakes or pies, these thus requiring more than the limited space 47 seen in FIG. 3. In such cases, the mode 3 stacking shown in FIG. 3 would not be utilized, and instead, each container 10 would be provided with a lid 42 to cover the contents within the respective recess 14.

Finally, it will be understood that, by aligning a plurality of the containers 10 in such a way that all of the step portions 36 were in registry, complete nesting of the containers could be accomplished, with the bottom walls 16 of all of the containers in close juxtaposition (i.e. closer than the juxtaposition shown in FIG. 3). This mode would be used for storage.

It will be appreciated that the container 10 and the lid 42 could be manufactured from a number of different kinds of materials. A preferred material would be a sterile plastic, such as a food grade styrene for the container 10 and a transparent vinyl for the top 42. Those skilled in the art will understand that other plastics such as PVC, polyester, and the like could also be utilized. This invention is not considered to be limited to any particular material.

The container 10 could be manufactured by any number of known techniques. For example it could be pressure formed, vacuum or thermo-formed, or blow molded. Further, the container 10 could be made in white or any of a number of colours. While it is of advantage for the lid 42 to be transparent, this is not essential.

While one embodiment of this invention has been illustrated in the accompanying drawings, and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. A stackable and nestable container for foodstuffs, the container comprising:

a body formed as an integral unit defining a single upwardly open recess that is substantially circular in outline, the recess having a bottom wall and a downwardly convergent, frusto-conical side wall, the body further defining two step portions communicating with said recess, the step portions projecting outwardly beyond said circular outline at diametrally opposed locations with respect to said recess, the body additionally defining two non-step portions also communicating with the recess, said non-step portions projecting outwardly beyond said circular outline at locations spaced substantially 90 degrees away from said diametrally opposed locations, the bottom wall being substantially flat, each step portion including a substantially flat contact wall generally parallel with the bottom wall but located in a plane spaced above the plane of said bottom wall, whereby when two such containers are rotationally oriented in a first position with respect to each other, the step portions of the containers coincide to allow close nesting of the containers, and when the containers are rotationally oriented in a second position with respect to each other, the step portions of one container coincide with the non-step portions of the other container to allow spaced stacking of the containers wherein the step portions of the lower container support substantially all of the weight of the higher container with the bottom wall of the higher container spaced upwardly away from the bottom wall of the lower container.

2. The invention claimed in claim 1, in combination with a lid adapted to cover said recess.

3. The invention claimed in claim 1, in which the contact wall is about halfway between the bottom wall and the top of the recess.

4. The invention claimed in claim 1, in which the bottom wall has ribs to enhance stiffness and to provide for air circulation.

5. The invention claimed in claim 1, in which the side wall means incorporates vertical stiffening ribs.

6. The invention claimed in claim 1, further having an upper flange portion projecting outwardly from the top of the recess.

7. The invention claimed in claim 6, in combination with a lid adapted to be applied against the flange portion in order to close the recess, the flange portion being roughened so as to allow air to enter or leave the recess in order to equalize the pressure within the recess during freezing or heating.

8. The invention claimed in claim 7, in which the lid has a downwardly projecting peripheral flange to enclose the periphery of the flange portion.

9. The invention claimed in claim 13, in which the periphery of the flange portion is substantially square.

10. The invention claimed in claim 6, in combination with a lid adapted to be applied against the flange portion in order to close the recess, the flange portion and the lid both being flat so that they may mate closely and be heat sealed together.

11. The invention claimed in claim 10, in which the lid has a downwardly projecting peripheral flange to enclose the periphery of the flange portion.

12. The invention claimed in claim 11, in which the periphery of the flange portion is substantially square.

* * * * *